US009070986B2

(12) United States Patent
Darrow

(10) Patent No.: US 9,070,986 B2
(45) Date of Patent: Jun. 30, 2015

(54) COAXIAL CONNECTOR WITH VISIBLE POST

(71) Applicant: CommScope, Inc. of North Carolina, Hickory, NC (US)

(72) Inventor: Robert E. Darrow, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 221 days.

(21) Appl. No.: 13/781,799

(22) Filed: Mar. 1, 2013

(65) Prior Publication Data

US 2014/0248797 A1 Sep. 4, 2014

(51) Int. Cl.
*H01R 9/05* (2006.01)
*H01R 13/02* (2006.01)

(52) U.S. Cl.
CPC ..... *H01R 9/0524* (2013.01); *H01R 13/025* (2013.01)

(58) Field of Classification Search
CPC ..... H01R 17/12; H01R 9/0518
USPC ..... 439/578, 580, 582, 584, 585
See application file for complete search history.

(56) References Cited

U.S. PATENT DOCUMENTS

| | | | | |
|---|---|---|---|---|
| 7,063,565 | B2 * | 6/2006 | Ward | 439/578 |
| 7,806,725 | B1 | 10/2010 | Chen | |
| 8,137,132 | B2 | 3/2012 | Lu | |
| 2011/0065317 | A1 * | 3/2011 | Shaw et al. | 439/578 |
| 2012/0270439 | A1 | 10/2012 | Tremba | |

* cited by examiner

*Primary Examiner* — Phuongchi T Nguyen
(74) *Attorney, Agent, or Firm* — Muncy, Geissler, Olds & Lowe, P.C.

(57) ABSTRACT

A coaxial cable connector includes a shell having an inner side wall defining a bore and an end opening at a first end of the shell, and a post is slidably mounted in the bore. The post includes a base engaging the shell inner side wall and a tube projecting from the base, the tube having an interior and an end aperture, and at least one of the post and the shell has a first detent for releasably holding the post in a first position in the bore and a second detent for securing the post at a second position in the bore.

19 Claims, 5 Drawing Sheets

COAXIAL CONNECTOR WITH VISIBLE POST

FIELD OF THE INVENTION

The present invention is directed to a coaxial connector having a post slidably mounted in a shell and, more specifically, toward a coaxial connector having a post slidably mounted in a shell with an end of the post positioned at an end opening of the shell such that the end of the post remains visible when a coaxial conductor is pressed against the end of the post.

BACKGROUND OF THE INVENTION

Coaxial cables generally include a central electrical conductor surrounded by a first dielectric or insulator. The central conductor is often made of copper, and the insulator may be formed from a foam or plastic. A sheath of braided metal strands and/or a metal foil is formed on the outer surface of the insulator to form an outer conductive shield. This sheath forms a ground shield and can be applied in various thickness which are known as single, double, and triple foil cable. The sheath in turn is surrounded by an outer insulating jacket to physically and electrically isolate the inside of the cable from the surrounding environment.

Coaxial cables are conventionally terminated with connectors that allow the cables to be connected to other cables and/or electrical devices. In order to install a connector at the end of a length of coaxial cable, the end of the coaxial cable must first be prepared to receive the connector. To prepare a coaxial cable, part of the outer insulating jacket is stripped from one end of the cable to expose a length of the metal conductive shield. Then, portions of the metal shield and the dielectric insulator are removed to expose a section of the central electrical conductor. The prepared end of the coaxial cable thus comprises a length of metal-shielded dielectric material projecting out of the jacket and a length of central conductor projecting out of the dielectric material.

A coaxial cable 100 is illustrated in FIG. 1 in the process of being inserted into a conventional connector 102, which may comprise, for example, a conventional F6 coaxial connector. The coaxial cable 100 includes an outer jacket 104 and a braided wire layer 105 and a layer of metal foil 106 between the outer jacket 104 and an insulating layer 108. The braided wire 105 is illustrated in FIG. 2 but omitted from the remaining figures for clarity. A central conductor 110 projects from an end of the exposed insulating layer 108. The connector 102 includes a shell 112 having an interior 114, and the shell 112 is formed from a sleeve 116 and a body 118. The shell 112 includes a first end 120 having a first end opening 122 formed in the sleeve 116 and a second end 124 having a second end opening 126 formed in the body 118. A nut 128 is connected to the body 118 at the second end 124 of the shell 112. A post 130 is formed of a base 132 and a tube 134, the tube 134 having an interior 136 and an end 138 with an aperture 140 at the end 138. The post 130 is pressed into the second end 124 of the shell 112 and retains the nut 128. The base 132 is mounted against the second end 124 of the shell 112 so that the tube 134 projects into the interior 114 of the shell 112 toward the first end opening 122. In this clamped position, the end aperture 140 of the tube 134 is located inside the shell 112 a distance from the first end opening 122.

As will be apparent from FIG. 1, the insulating layer 108 of the coaxial cable 100 must be inserted a distance into the interior 114 of the connector 102 before it contacts the end 138 of the post 130. Once the insulating layer 108 is inserted into the connector 102, however, a person attaching the connector 102 to the coaxial cable 100 can no longer see the end of the insulator 108. The presence of the folded back braided foil 105 further blocks the view of the interior of the connector 102. A user therefore must align the insulator 108 and its metal foil layer 106 with the aperture 138 of the tube 134 by feel. If the alignment is not precise, the foil layer 106 at the end of the insulating layer 108 may be damaged, and a damaged section 142 of the metal foil layer 106 is illustrated in FIG. 1. This damaged section 142 may adversely affect the performance of the connector 102 by causing direct and/or intermittent short circuits when the insulator 108 is later properly inserted into the interior 136 of the post 130 or may make it impossible to properly connect the coaxial cable 100 to the connector 102 and thus require that the end portion of the coaxial cable 100 be cut off and prepared again for a second attempt at attachment to the connector 102.

It would therefore be desirable to provide a connector that connects to a coaxial cable in a manner that substantially avoids the forgoing difficulties.

SUMMARY OF THE INVENTION

These and other problems are addressed by embodiments of the present invention, a first aspect of which comprises a coaxial cable connector having a shell having an inner side wall defining a bore and an end opening at a first end of the shell. A post is slidably mounted in the bore, and the post includes a base engaging the shell inner side wall and a tube projecting from the base. The tube has an interior and an end aperture, and at least one of the post and the shell has a first detent for releasably holding the post in a first position in the bore and a second detent for securing the post at a second position in the bore.

Another aspect of the invention comprises a coaxial cable connector having post means for receiving a central conductor of a coaxial cable and for extending between an outer conductor of the coaxial cable and a cable jacket and shell means for slidably supporting the post means, the shell means having an inner side wall defining a bore and an end opening.

A further aspect of the invention comprises a coaxial cable connector having a shell having an inner side wall defining a bore and a first end opening at a first end of the shell and a second end opening at a second end of the shell. A post is slidably mounted in the bore, and the post includes a base having a diameter that engages the shell inner side wall and a tube projecting from the base. The tube has an interior and an end aperture, and a nut is mounted on the second end of the shell. The post does not extend into the nut. The bore has a first portion having a diameter for accommodating the base and a second portion at the second end of the shell having a diameter smaller than the diameter of the base, and the post is located entirely in the first portion.

BRIEF DESCRIPTION OF THE DRAWINGS

These and other aspects and features of embodiments of the present invention will be better understood after a reading of the following detailed description together with the attached drawings wherein.

DETAILED DESCRIPTION

Figure 1:
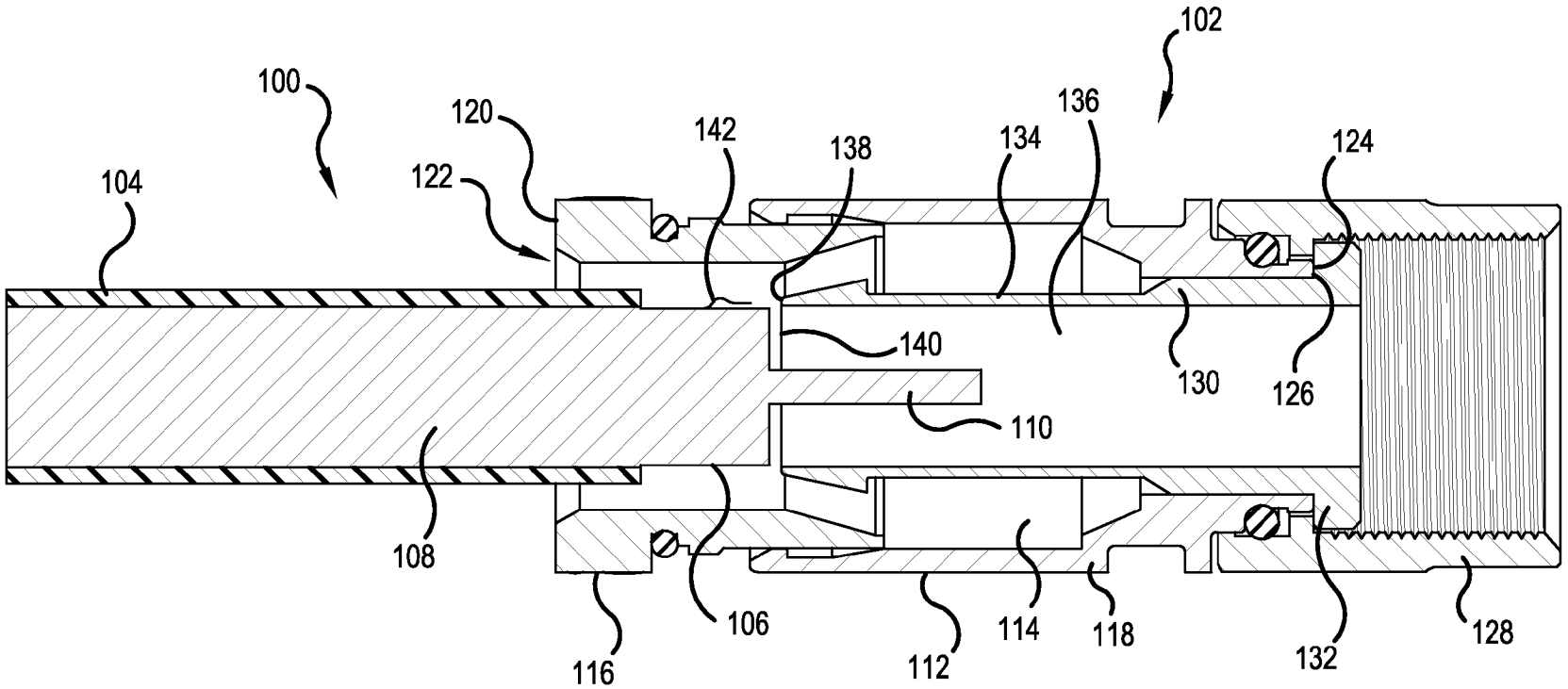
FIG. 1 CONVENTIONAL ART
FIG. 1 is sectional side elevational view of a length of coaxial cable being inserted into a conventional connector.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 2:
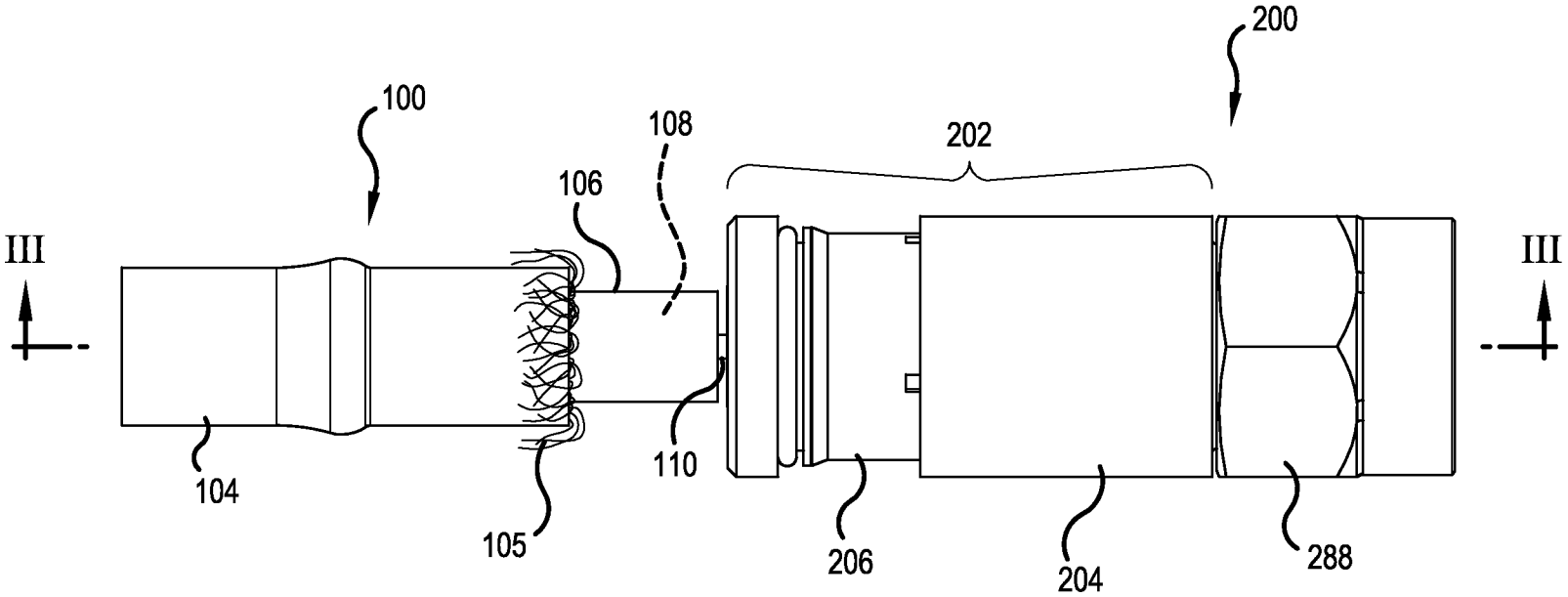
FIG. 2 is a side elevational view of a length of coaxial cable inserted a first distance into a connector according to a first embodiment of the present invention.

FIG. 2 illustrates a length of the coaxial cable 100 of FIG. 1 being inserted into a connector 200 according to a first embodiment of the present invention. The connector 200 includes a shell 202 formed of a body 204 and a sleeve 206 slidably mounted in the body 204 for movement between an extended position relative to the body 204, illustrated in FIG. 2, with a majority of the sleeve 206 extending outside the body 204, and a retracted position relative to the body 204, illustrated in FIG. 6 and described hereinafter, in which much of the sleeve 206 is located inside the body 204. Connectors formed as one-piece shells and shells that have sleeves fixedly mounted to body portions in a non-sliding manner are also known, and embodiments of the present invention can be practiced using these sleeves as well.

Figure 3:
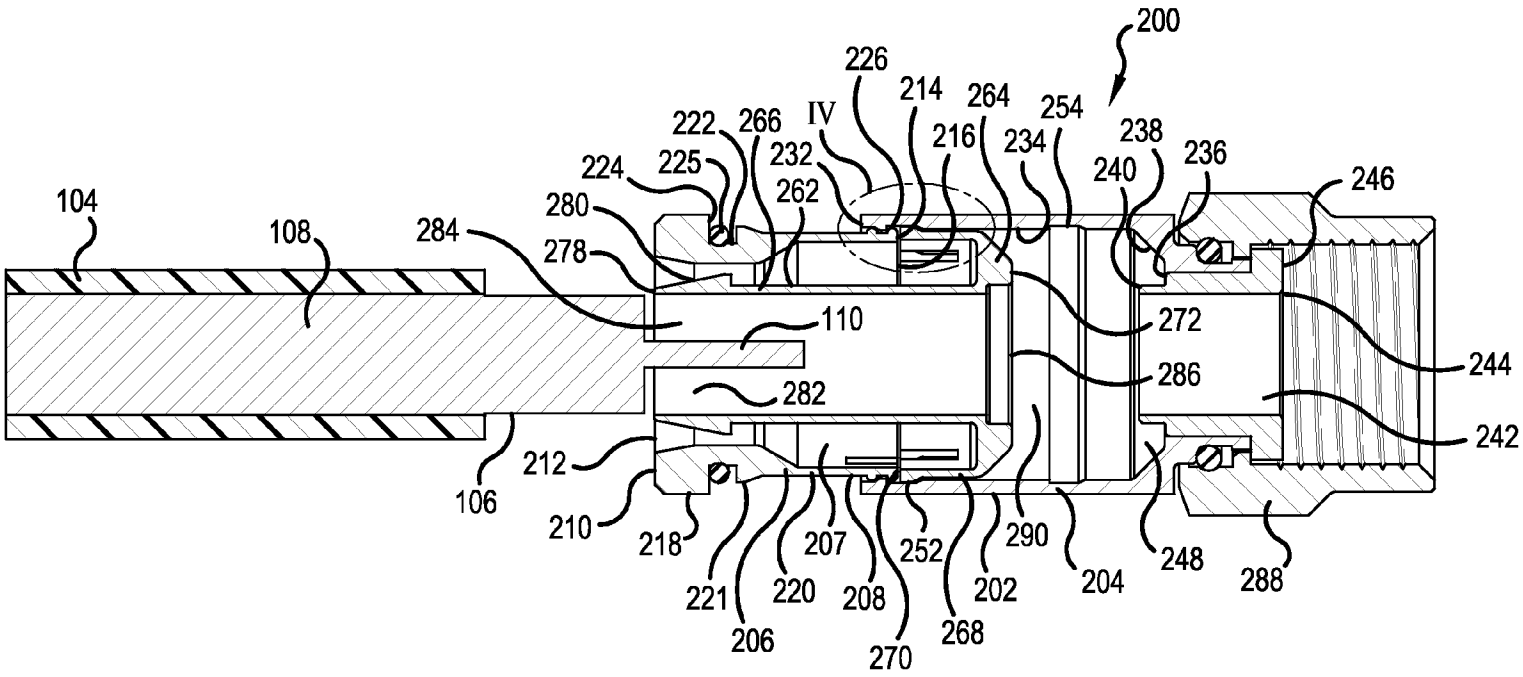
FIG. 3 is a sectional side elevational view taken along line III-III in FIG. 2.
Figure 4:
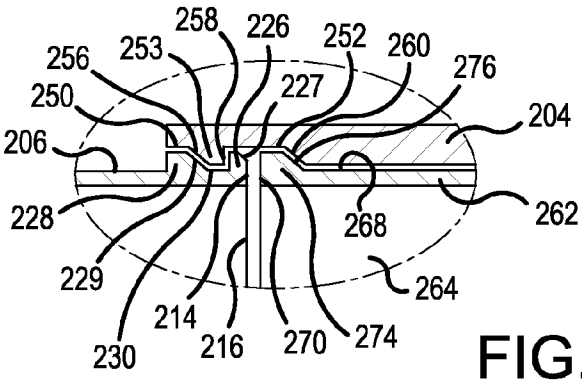
FIG. 4 is a detail view of portion IV of FIG. 3.

Referring now to FIGS. 3 and 4, the sleeve 206 includes an interior 207, a cylindrical outer side wall 208, a first end 210 having a first end opening 212, and a second end 214 having a second end opening 216. A first portion 218 of the cylindrical outer side wall 208 near the first end 210 has an outer diameter that is larger than a second portion 220 of the cylindrical outer side wall 208 near the second end 214, and the first portion 218 is connected to the second portion 220 by a tapered transition side wall portion 221. A groove 222 is formed in the transition side wall portion 221, and a wall 224 of the groove 222 that faces the sleeve second end 214 forms a stop surface discussed hereinafter. An O-ring 225 is seated in the groove 222. The outer side wall 208 also includes an outwardly projecting end flange 226 with a cam surface 227 around the second end opening 216, an outwardly projecting ridge 228 axially spaced from the end flange 226 and having a cam surface 229 facing the end flange 226, and a groove 230 between the end flange 226 and the ridge 228.

The body 204 has a first end opening 232 and an interior side wall 234 that extends inwardly from the first end opening 232 to an interior wall 236, and the interior side wall 234 includes an angled side wall portion 238 at the interior wall 236. A flange 240 projects from the interior wall 236 and surrounds an opening into a passage 242 that extends from the interior wall 236 to a second end opening 244 at a second end 246 of the body 204. The flange 240, interior wall 236 and angled side wall portion 238 together define a post-receiving seat 248 discussed hereinafter.

The interior side wall 234 also includes an annular step 250 at the second end opening 232, a first annular groove 252 axially inward of the step 250 and an annular ridge 253 between the annular step 250 and the first annular groove 252. A second annular groove 254 is formed between the first annular groove 252 and the interior wall 236. As illustrated in the detail view of FIG. 4, the step 250 includes a first cam surface 256, and the first annular groove 252 includes a stop surface 258 generally perpendicular to the longitudinal axis of the sleeve 204 and a cam surface 260 axially inward of the stop surface 258.

The connector 200 further includes a post 262 having a base 264 and a tube 266 extending from the base 264. The base 264 includes a base side wall 268 that engages the interior side wall 234 of the body 204 and an annular base wall 270 surrounding the tube 266 and a base end 272. The base side wall 268 includes a projecting flange 274 at the annular base wall 270, and the projecting flange 274 has a cam surface 276 facing the base end 272. The tube 266 includes an annular end surface 278 and a barb 280 at least partially surrounding the annular end surface 278, and a passage 282 extends through the post 262 from an aperture 284 at the annular end surface 278 to an opening 286 in the base end 272. A nut 288 is attached at the second end 246 of the body 204 to allow the connector 200 to connect to another connector, not illustrated.

The connector 200 has an initial configuration in which the sleeve 206 is in its extended position relative to the body 204 and the post 262 is positioned in the interior of the body 204 with its base side wall 268 in contact with the interior side wall 234 of the body 204. In this configuration, the projecting flange 274 of the base side wall 268 is positioned in the first annular groove 252 in the interior side wall 234 of the body 204, and the base end 272 of the post 262 faces and is spaced from the interior wall 236 of the body 204. The tube 266 extends through the first end opening 232 of the body 204. The sleeve 206 is mounted to the body 204 with the second end 214 of the sleeve 206 abutting or closely spaced from the annular base wall 270 of the post 262 with the end flange 226 of the sleeve 206 in the first annular groove 252 of the body interior side wall 234 adjacent to the projecting flange 274 of the side wall 268 of the post base 264. The annular ridge 253 on the interior side wall 234 extends into the groove 230 in the sleeve 206 between the sleeve end flange 226 and the ridge 228. In this configuration, the annular end surface 278 of the tube 266 and the aperture 284 therein are located at or generally in the plane of the first end opening 212 of the sleeve 206.

In the following description, the first end opening 212 of the sleeve 206 may also be referred to as a first end opening of the shell 202, the second end opening 244 of the body 204 may be referred to as a second end opening of the shell 202 and the interior of the sleeve 206 and the interior of the body 204 up to the post receiving seat 248 may be referred to as a bore 290 of the shell 202. The relationship between the coaxial cable 100 and the shell 202 will be described as if the sleeve 206 and body 204 were a single unit until it becomes necessary to describe relative movement between the sleeve 206 and the body 204 with reference to FIG. 7.

In use, a coaxial cable 100 prepared in a conventional manner as described above is brought toward the connector 200, and the central conductor 110 of the coaxial cable 100 is inserted through the aperture 284 of the post 262 and into the passage 282. As illustrated in FIG. 3, with the aperture 284 and axial end surface 278 of the post 262 located at the first end opening 212 of the shell 202, the axial end surface 278 remains visible until it is contacted by the insulating layer 108 of the coaxial cable 100. The braided wire 105 (omitted from FIG. 3 for clarity) also does not block the view of the insulating layer 108 at the axial end surface 278. Conventional connectors, such as the connector 102 illustrated in FIG. 1, have posts which are located sufficiently far inside a shell 112 that the aperture 140 of the tube 134 is not visible when the coaxial cable 100 is inserted. By locating the aperture 284 at the first end opening 212 of the shell 202, a person attaching the connector 200 to a coaxial cable 100 can see the junction between the insulating layer 108 of the coaxial cable and the post 262, and this reduces the likelihood of damaging the metal foil 106 on the insulating layer 108 during the remainder of the installation process.

As used herein, the aperture 284 being located "at" the first end opening 212 of the shell 202 is intended to describe conditions where the annular end surface 278 and end aperture 284 lie in the same plane as the first end opening 212 of the shell 202 and situations where the annular end surface 278 is located somewhat outside the shell 202. The annular end surface 278 of the post 262 is also considered to be "at" the first end opening 212 of the shell 202 when it is located slightly inside the shell 202 by a distance small enough, less than 1 mm, for example, to leave the annular end surface 278 visible when the insulator 108 of a coaxial cable 100 is pressed thereagainst under typical installation conditions. Such typical installation conditions would comprise an installer holding the connector 200 in one hand and a prepared length of coaxial cable 100 in the other hand and moving the center conductor 110 of the coaxial cable 100 toward the passage 282 in the tube 266 of the post 262. During this process, the first end opening 212 would likely be angled about 30 to 90 degrees away from the installer's line of sight. That is, the installer would not be looking directly into the first end opening 212 before installing the coaxial cable 100 but rather would have the connector 200 positioned to facilitate insertion of the coaxial cable while looking at the annular end surface 278 of the post 262. Placing the annular end surface 278 at or slightly outside the first end opening 212 increases the visibility of the post 262, but positioning the annular end surfaced 278 a sufficiently small distance inside the first end opening 212 that it remains visible when contacted by the insulator 108 of the coaxial cable 100 is also within the scope of this disclosure.

Figure 8:
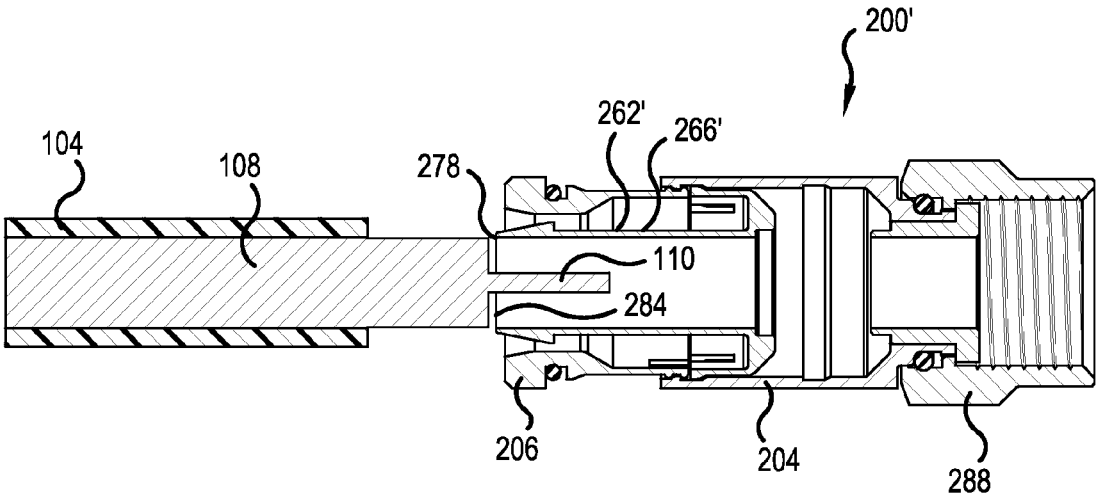
FIG. 8 is a sectional side elevational view of a coaxial cable inserted into a connector according to a second embodiment of the present invention.
Figure 9:
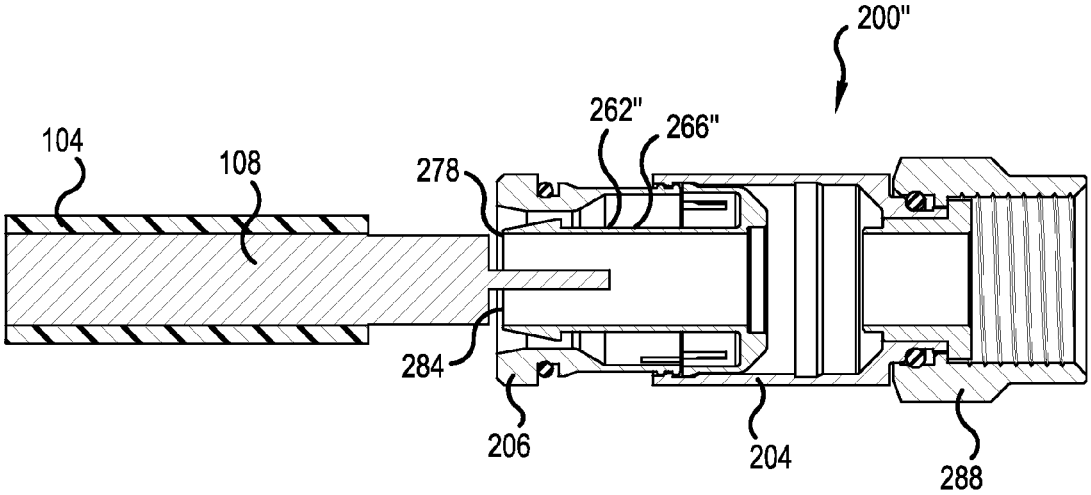
FIG. 9 is a sectional side elevational view of a coaxial cable inserted into a connector according to a third embodiment of the present invention.

FIG. 8 shows a second embodiment of a connector 200' that includes a post 262' with a tube 266' having a length that places the annular end surface 278 of the post 262' outside the shell 202 when the post 262' is mounted in the shell 202 as described above. All other elements of the embodiment of FIG. 8 are identical to those described above. FIG. 9 shows a third embodiment of a connector 200" that includes a post 262" with a tube 266" having a length that leaves the annular end surface 278 of the post 262" just inside the shell 202 when the post 262" is mounted in the shell 202 as described above. All three embodiments are used in substantially the same manner, and therefore only the attachment of the coaxial cable 100 to the connector 200 of FIG. 3 is described below.

Figure 5:
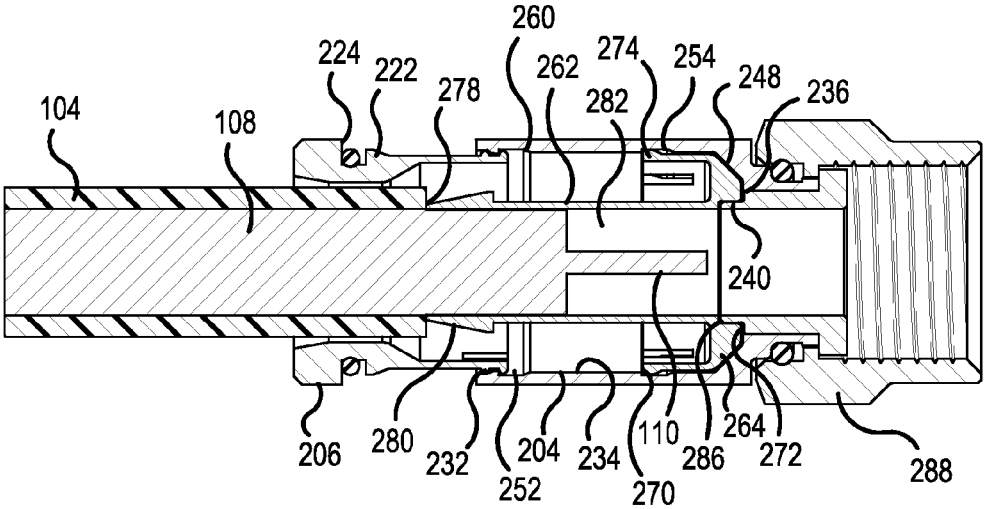
FIG. 5 is a sectional side elevational view showing the coaxial connector of FIG. 3 inserted a greater distance into the connector.

After the insulator 108 is brought into contact with the annular end surface 278 of the post 262, the connector 200 and the coaxial cable 100 are brought together under increasing pressure, by hand or using a suitable conventional tool (not illustrated), and this pressure forces the cam surface 276 of the projecting flange 274 of the base side wall 268 of the post 262 against and along the cam surface 260 of the first annular groove 252 in the interior side wall 234 of the body 204. This pressure deforms the interior side wall 234 of the body 204 and/or the base side wall 268 of the post 262 sufficiently to allow the projecting flange 274 to exit the first annular groove 252 and slide along the interior side wall 234 of the body 204 toward the second annular groove 254. With reference to FIG. 5, as the post 262 moves deeper into the body 204 under pressure from the coaxial cable 100, the flange 240 on the interior wall 236 of the body 204 enters the opening 286 in the base end 272 of the post 262, and a portion of the base 264 including the base end 272 enter the post receiving seat 248 of the body 204. At this time, the projecting flange 274 of the base side wall 268 of the post 262 enters the second annular groove 254 in the interior side wall 234 of the body 204. The post receiving seat 248 prevents the post 262 from moving further into the body 204 and the flange 274 in the second annular groove 254 substantially prevents the post 262 from moving back toward the sleeve 206.

Pressing the insulator 108 of the coaxial cable against the annular end surface 278 of the post 262 is intended to force the insulator 108 into the passage 282 in the post 262. Therefore, the flexibility of the base side wall 268 and the body 204 and the sizes and shapes of the projecting flange 274 and the first annular groove 252 are selected such that the post 262 will not move until at least a portion of the insulator 108 has entered the passage 282. A suitable adhesive or a friction fit between the post 262 and the interior side wall 234 could alternately be used to hold the post in the first position. If the insulator 108 is not fully inserted into the passage 282 when the post 262 releases from the detent formed by the projecting flange 274 and the first annular groove 252, further insertion will occur when the base 264 is received in the post receiving seat 248 and the post 262 can move no further into the shell 202. FIG. 5 shows the insulator 108 and the central conductor 110 in the passage 282 and the post base end 272 in the post receiving seat 248.

With the post 262 secured in position and retained by the second annular groove 254, the remaining process of attaching the connector 200 to the coaxial cable 100 is generally similar to conventional attachment methods. Specifically, with reference to FIG. 6, the coaxial cable 100 is inserted further into the post 262 until the center conductor 110 of the coaxial cable 100 passes out of the second end opening 244 of the body 204 and the insulator 108 moves through the passage 282 in the post 262 and into the passage 242 in the body 204. During this movement, the barb 280 at the end of the tube 266 of the post 262 slides between the metal foil 106 and the outer jacket 104 of the coaxial cable 100, securely seating the coaxial cable 100 on the post 262.

Figure 6:
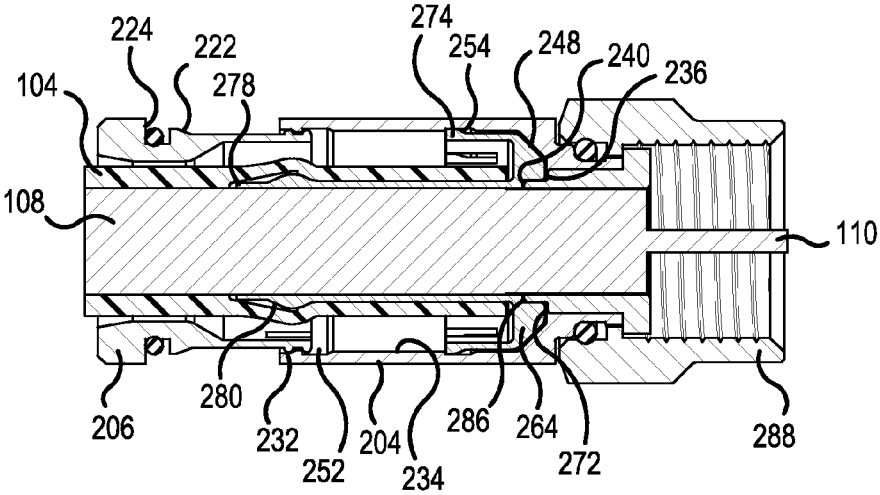
FIG. 6 is a sectional side elevational view showing the coaxial connector of FIG. 3 fully inserted into the connector.
Figure 7:
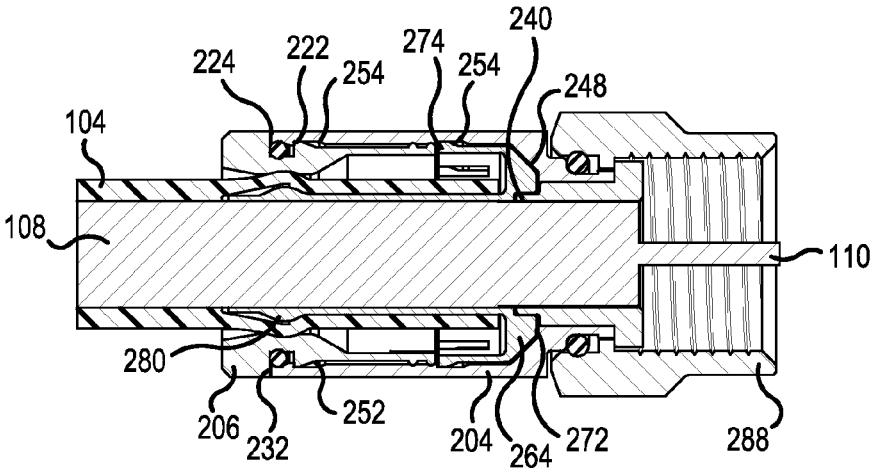
FIG. 7 is a sectional side elevational view of the coaxial cable fully inserted into the connector with a sleeve portion of the connector moved into a retracted position.

With reference to FIGS. 6 and 7 and the detail view of FIG. 4, manually or using a tool (not illustrated) the sleeve 206 is pressed toward the body 204 with sufficient force to drive the cam surface 229 of the ridge 228 against an the ridge 253 of the interior side wall 238 of the body 204 and move the sleeve 206 into the body 204 until the O-ring 225 enters the annular step 250. The wall 224 of the sleeve 206 engages the body 204 and the tapered transition side wall portion 221 of the cylindrical side wall 208 of the sleeve 206 snaps into the first annular groove 252 as shown in FIG. 7. The ridge 253 of the interior side wall 234 of the body 204 also enters the groove 222 to help secure the sleeve 206 in place. At this point, the sleeve 206 is securely connected to the body 204 and the outer jacket 104 is pinched between the barb 280 and the interior of the sleeve 206. At this time a retention test may be performed by pulling the coaxial cable 100 away from the connector 200. However, the presence of the projecting flange 274 in the second annular groove 254 substantially prevents the post 262 from being pulled out of the shell 202, and the presence of an edge of the groove 222 in the first annular groove 252 of the body 204 also ensures that the connector 200 will securely retain the coaxial cable 100. The connector 200 can then be connected to a complementary connector or electronic device (not illustrated) in a conventional manner with a lower likelihood of damage to the metal foil layer 106 of the coaxial cable 100.

The present invention has been described herein in terms of presently preferred embodiments. However, modifications and additions to these embodiments will become apparent to persons of ordinary skill in the art upon a reading of the foregoing description. It is intended that all such modifications and additions form a part of the present application to the extent they fall within the scope of the several claims appended hereto.

What is claimed is:

1. A coaxial cable connector comprising:

a body having a first end opening and a second end opening and an inner side wall defining a bore between the first end opening and the second end opening;

a nut mounted to the body proximate the second end opening of the body, wherein the nut allows the coaxial cable connector to connect to another connector;

a sleeve having a first end opening at a first end of the sleeve and a second end opening at a second end of the sleeve, wherein the second end opening of the sleeve is mounted to the body proximate the first end opening of the body; and a post slidably mounted in the bore, the post including a base engaging the body inner side wall and a tube projecting from the base toward the first end opening of the sleeve, the tube having an interior and an end aperture, at least one of the post and the body having a first detent for holding the post in a first position in the bore and at least one of the post and the body having a second detent for holding the post at a second position in the bore, wherein the base of the post is closer to the nut in the second position as compared to the first position.

2. The coaxial cable connector of claim 1, including a barb at the end aperture.

3. The coaxial cable connector of claim 1, wherein the end aperture is located at the first end opening of the sleeve when the post is in the first position.

4. The coaxial cable connector of claim 1, wherein the first detent is configured to permit movement of the post from the first position to the second position and wherein the second detent is configured to prevent movement of the post from the second position to the first position.

5. The coaxial cable connector of claim 1, wherein the end aperture is surrounded by an annular end surface and including a barb at the end aperture, wherein the tube is configured to receive a center conductor, an insulator and an outer conductor of a coaxial cable, and wherein, when the post is in the first position and the insulator is in contact with the annular end surface, the barb is visible from outside the sleeve.

6. The coaxial cable connector of claim 1, wherein the end aperture is located at a first end of the post, wherein the post includes a second end spaced from the post first end which includes the base, and wherein the base is located entirely within the body when the post is in either of the first or second positions.

7. The coaxial cable connector of claim 6, wherein the post does not extend into the nut, when the post is in either of the first or second positions.

8. The coaxial cable connector of claim 1, wherein the sleeve is slidably mounted to the body, and wherein the sleeve is movable from an extended position relative to the body to a retracted position relative to the body, wherein the sleeve is closer to the nut in the retracted position as compared to the extended position.

9. The coaxial cable connector of claim 8, wherein the end aperture is located outside the first end opening of the sleeve when the sleeve is in the extended position and the post is in the first position.

10. The coaxial cable connector of claim 8, wherein the end aperture is located at the first end opening of the sleeve when the sleeve is in the extended position and the post is in the first position.

11. The coaxial cable connector of claim 8, wherein the end aperture is located one millimeter or less inside the first end opening of the sleeve when the sleeve is in the extended position and the post is in the first position.

12. The coaxial cable connector of claim 8, wherein the end aperture includes a barb and is located a first distance from the first end opening of the sleeve when the sleeve is in the extended position and the post is in the first position and wherein the end aperture is located inside the shell and a second distance from the first end opening of the sleeve when the sleeve is in the extended position and the post is in the second position, the second distance being greater than the first distance, wherein the first detent is configured to permit movement of the post from the first position to the second position and wherein the second detent is configured to prevent movement of the post from the second position to the first position, and wherein the end aperture is located at a first end of the post, the post includes a second end spaced from the post first end which includes the base, and wherein the base is located entirely within the body and the post does not extend into the nut when the post is in either of the first or second positions.

13. A coaxial cable connector comprising:

post means for receiving a central conductor of a coaxial cable and for extending between an outer conductor of the coaxial cable and a cable jacket;

shell means for slidably supporting the post means, the shell means having an inner side wall defining a bore and a first end opening at a first end of the shell means and a second end opening at a second end of the shell means; and a nut means mounted to the second end of the shell means, wherein the nut means allows the coaxial cable connector to connect to another connector, wherein the shell means allows the post means to slide from a first position to a second position within the bore, with the post means being closer to the nut means in the second position as compared to the first position.

14. The coaxial cable connector of claim 13, further including holding means for holding the post means at the first position in the bore and locking means for locking the post means at the second position in the bore.

15. The coaxial cable connector of claim 13, wherein the shell means comprises a body portion and a sleeve portion slidably mounted to the body portion for sliding movement between an extended position relative to the body portion and a retracted position relative to the body portion, wherein the first end opening is formed in the sleeve portion, and wherein an end of the post means is located a first distance from the first end opening when the sleeve is in the extended position and the post is in the first position and is located a second distance from the first end opening when the sleeve is in the extended position and the post is in the second position, the second distance being greater than the first distance.

16. A coaxial cable connector comprising:

a shell having an inner side wall defining a bore and a first end opening at a first end of the shell and a second end opening at a second end of the shell;

a post slidably mounted in the bore, the post including a base having a diameter and engaging the shell inner side wall and a tube projecting from the base, the tube having an interior and an end aperture; and a nut mounted to the second end of the shell, wherein the nut allows the coaxial cable connector to connect to another connector, and wherein the post does not extend into the nut;

wherein at least one of the post and the shell has a first detent for holding the post in a first position in the bore and at least one of the post and the shell has a second detent for holding the post at a second position in the bore, wherein the base of the post is closer to the nut in the second position as compared to the first position.

17. The coaxial cable connector of claim 16, wherein when the post in the first position, the end aperture of the post is visible when a center conductor of a coaxial cable is inserted in the tube and an insulating portion of the coaxial cable contacts the post.

18. The coaxial cable connector of claim 17, wherein the first detent releasably holds the post in the first position in the bore and the second detent secures the post at the second position in the bore.

19. The coaxial cable connector of claim 18, wherein the shell comprises a sleeve slidably mounted on a body and wherein the shell is shiftable from an extended position relative to the body to a retracted position relative to the body, wherein the first end opening of the shell is located in the sleeve, wherein the end aperture of the post is located at the end opening of the sleeve when the sleeve is in the extended position and the post is in the first position.

* * * * *